US005896115A

United States Patent [19]

Yano et al.

[11] Patent Number: 5,896,115

[45] Date of Patent: Apr. 20, 1999

[54] METHOD FOR DRIVING IMAGE DISPLAY DEVICE AND UNIT THEREFOR

[75] Inventors: Kazuyuki Yano; Mitsuru Tanaka, both of Mobara, Japan

[73] Assignee: Futaba Denshi kogyo, K.K., Mobara, Japan

[21] Appl. No.: 08/635,381

[22] Filed: Apr. 19, 1996

[30] Foreign Application Priority Data

Apr. 19, 1995 [JP] Japan ..... 7-116580

[51] Int. Cl.[6] ..... G09G 3/22

[52] U.S. Cl. ..... 345/74; 345/208

[58] Field of Search ..... 345/74, 75, 147, 345/148, 76, 77, 208, 209, 210, 211, 212, 89; 315/169.1, 169.2, 169.3; 313/495, 496, 497, 308, 309, 351

[56] References Cited

U.S. PATENT DOCUMENTS 4,613,854 9/1986 Holz ..... 345/208
4,899,081 2/1990 Kishino et al. .
5,011,269 4/1991 Wakita et al. ..... 345/89
5,153,483 10/1992 Kishino et al. ..... 315/169.1
5,202,674 4/1993 Takemori et al. ..... 345/75
5,572,231 11/1996 Kobori ..... 345/74

*Primary Examiner*—Xiao Wu
*Attorney, Agent, or Firm*—Oblon, Spivak, Mcclelland, Maier & Neudstadt, P.C.

[57] ABSTRACT

A unit for driving an image display device capable of preventing occurrence of luminescent spots on a display plane due to a leakage voltage of the unit. The drive unit includes gate electrodes and cathode electrodes arranged so as to define a matrix by cooperation with each other. At least two reset pulses are applied to each of the gate electrodes during a period of time for which it is kept nonselected to cause a voltage increased due to the leakage voltage to be reduced to a level of a reference potential and the gate electrode is kept at an increased impedance during a period of time for which the gate electrode is kept from being fed with the reset pulses.

2 Claims, 7 Drawing Sheets

METHOD FOR DRIVING IMAGE DISPLAY DEVICE AND UNIT THEREFOR

BACKGROUND OF THE INVENTION

This invention relates to a method for driving an image display device including scan electrodes arranged in a matrix-like manner and a unit therefor, and more particularly to such a method and a unit which are suitably applied to an image display device having field-emission cathodes incorporated therein.

When an electric field which is set to be about $10^9$ (V/m) is applied to a surface of a metal material or that of a semiconductor material, a tunnel effect permits electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode".

Recent development of semiconductor processing techniques permits a field emission cathode elements of a size as small as microns to be produced. This results in a field emission cathode of the surface emission type being made of an array of the field emission cathode elements thus produced, so that research and development of an image display device using the field emission cathode have been made.

Now, a field emission cathode (hereinafter also referred to as "FEC") commonly called a Spindt-type prepared by semiconductor processing techniques will be described hereinafter as an example of a conventional field emission cathode with reference to FIG. 4. The conventional field emission cathode includes a substrate 100 made of glass or the like, on which cathode electrodes 102 are formed of metal such as aluminum or the like by deposition. The cathode electrodes 102 each are formed thereon with emitters 104 of a conical shape, each of which may be made of metal such as molybdenum or the like.

The cathode electrodes 102 each are formed on a portion thereof which is not provided with the emitters 104 with a film 106 of silicon dioxide ($SiO_2$), which is then formed thereon with a gate 108. The gate 108 and $SiO_2$ film 106 are formed with a plurality of through-holes 110 of a circular shape in cross section in a manner to be common to both.

Such construction results in the emitters 104 being arranged so as to be exposed via the through-holes 110 while being supported on the cathode electrode 102, respectively.

The emitters 104 of a conical shape are arranged so as to be spaced from each other at pitches as small as 10 microns or less, so that a large number of emitters or tens of thousands to hundreds of thousands of emitters may be mounted on one substrate. Also, the conventional field emission cathode permits a distance between the gate and a distal end of each of the emitters to be as small as less than 1 micron, so that application of a voltage $V_{GC}$ as low as only tens of volts between the gate 108 and the emitters 104 may permit the emitters to field-emit electrons therefrom. The electrons thus field-emitted from the emitters 104 are captured by an anode 112 arranged at a predetermined interval above the gate 108 and having a positive voltage $V_A$ applied thereto.

Characteristics between an anode current Ia of the conventional FEC thus constructed and a gate-cathode voltage $V_{GC}$ thereof are shown in FIG. 5. As shown in FIG. 5, as the gate-cathode voltage $V_{GC}$ is gradually increased, the anode current $I_a$ starts to flow to the anode 112. The voltage $V_{GC}$ at which the anode current Ia starts to flow thereto is referred to as a threshold voltage $V_{TH}$, which causes an electric field between the gate 108 and the cathode 102 to be about $10^9$ V/m, resulting in electrons starting to be emitted from the emitters 104, so that the anode current Ia starts to flow to the anode 112. In general, a voltage of about $V_{OP}$ shown in FIG. 5 which is considerably higher than the threshold voltage $V_{TH}$ is applied between the gate 108 and the cathode 102, during which the anode current $I_{OP}$ is permitted to flow to the anode 112.

The anode current derived from each one of the emitters 104 of a conical shape is at a micro-level. In view of the fact, the conventional FEC arranges a plurality of emitters in a manner like an array, to thereby increase the anode current to a desired level.

In this instance, formation of phosphors on the anode 112 results in electrons field-emitted from the emitters 104 impinging on the phosphors during capture of the electrons by the anode, leading to luminescence of the phosphors. Application of such a principle to a display device leads to realization of an image display device having an FEC incorporated therein (hereinafter also referred to as "FED").

Such an FED may be driven by such a drive unit constructed as shown in FIG. 6 by way of example and adapted to carry out operation as shown in FIG. 2.

More particularly, the drive unit, as shown in FIG. 6, includes a shift register 20 which has gate data and clocks (CLK) for shift inputted thereto. The shift register 20 then feeds the gate data to gate drivers 21-1 to 21-n in order. The gate data applied to the gate drivers 21-1 to 21-n have such sequence pulses as indicated at GT1 to GTn in FIG. 2, which are generated at a cycle nT, wherein T indicates a pulse width of each of the pulses.

Each of the gate drivers 21-1 to 21-n may be constructed of a driver IC or the like and has transistors Tr1 and Tr2 connected thereto to provide a push-pull circuit, so that gate electrodes 22-1 to 22-n each may be driven at an increased speed. The transistor Tr1 has a drive power supply $V_G$ connected to a terminal of a source thereof, and the transistor Tr2 has a bias power supply $V_S$ connected to a terminal of a source thereof so that each of the gate electrodes 22-1 to 22-n may be driven at a reduced swing voltage.

The gate electrodes 22-1 to 22-n each are formed into a stripe-like manner, wherein the gate driver 21-1 is adapted to drive the gate electrode 22-1, the gate driver 21-2 drives the gate electrode 22-2,—and subsequently the last gate driver 21-n drives the last gate electrode 22-n. Thus, supposing that gate data are applied to the gate driver 21-1, resulting in the gate driver 21-1 being selected, the transistor Tr1 of the gate driver 21-1 is caused to be turned on to apply the voltages $V_G+V_S$ to the gate electrode 22-1, leading to the driving of the gate electrode 22-1.

Then, when the gate data are transferred from the gate driver 21-1 to the next gate driver 21-2 to render the gate driver 21-1 nonselected, the transistors Tr1 and Tr2 of the gate driver 21-1 are turned off and turned on, respectively, so that the gate electrode 22-1 may be kept at a bias voltage $V_S$.

The bias voltage $V_S$ is set at a level of the threshold voltage $V_{TH}$ between the gate and the cathode or below.

A shift register 23 has serial cathode data inputted thereto, which are converted into parallel cathode data in the register 23 and then latched in a latch circuit 24. For this purpose, the shift register 23 has clocks (CLK) for shift inputted thereto. The cathode data thus latched in the latch circuit 24 are fed to cathode drivers 25-1 to 25-m, respectively. The cathode data fed to the cathode drivers 25-1 to 25-m serve as such image data of a cycle T as indicated at C1 to Cm to FIG. 2.

Cathode electrodes 26-1 to 26-m each are formed into a stripe-like shape and driven by the cathode drivers 25-1 to 25-m in order, respectively.

The gate electrodes 22-1 to 22-n and cathode electrodes 26-1 to 26-m are arranged so as to define a matrix by cooperation with each other. The cathode electrodes 26-1 to 26-m are provided on portions thereof positionally corresponding to intersections between the gate electrodes 22-1 to 22-n and the cathode electrodes 26-1 to 26-m with emitter arrays $E_{11}$, $E_{12}$, - - - , $E_{21}$, $E_{22}$, - - - , $E_{nm}$, which constitute picture cells for the image display device.

Thus, when the gate drivers 21-1 to 21-n are selected in order and the gate electrodes 22-1 to 22-n are driven in order, a voltage of a predetermined level is applied between the gate electrodes and the cathode electrodes to permit electrons to be emitted from the emitter arrays, which electrons are then captured by the anode arranged apart upwardly from the the gate electrodes 22-1 to 22-n.

Then, the electrons thus emitted from the emitter arrays are caused to impinge on the phosphors deposited on the anode, leading to luminescence of the phosphors. At this time, the image data are kept applied to the cathode electrodes 26-1 to 26-m as described above, so that luminescence of the phosphors is carried out depending on the image data, to thereby provide a desired image display.

As described above, the gate drivers 21-1 to 21-n of the drive unit for the image display device have a bias voltage $V_S$ applied thereto in order to minimize the swing voltage. For example, when the gate data are transferred from the gate electrode 22-1 to the gate electrode 22-2 to render the gate driver 21-1 nonselected, the bias voltage $V_S$ is applied to the gate electrode 22-1.

However, application of the bias voltage $V_S$ to the gate electrode when the gate driver is kept nonselected causes a gate voltage charged in the gate electrode to be discharged from the gate drive power supply $V_G$ and cathode drive power supply $V_C$, leading to occurrence of a reactive power.

In view of the problem, it is proposed to ground each of the gate electrodes once during non-selection of each of the gate drivers and then keep the gate electrode at an increased impedance, leading to electrical isolation of the gate electrode.

In this instance, the transistors Tr1 and Tr2 of each of the gate drivers 21-1 to 21-n shown in FIG. 6 are driven independently from each other and, for example, the terminal of the source of the transistor Tr2 is grounded.

Thus, when a scan pulse is applied to, for example, the gate driver 21-1 as shown in (a) of FIG. 7, the transistors Tr1 and Tr2 of the gate driver 21-1 are turned on and turned off, respectively, so that the gate electrode 22-1 is applied thereto a voltage Vg, resulting in being driven.

Then, when the scan pulse is transferred from the gate driver 21-1 to the gate driver 21-2 to render the gate driver 21-2 nonselected, the transistor Tr1 of the gate driver 21-1 is turned off and the transistor Tr2 of the gate driver 21-1 is applied thereto a reset pulse for a predetermined period of time T as shown in (b) of FIG. 7, resulting in the gate electrode 22-1 being grounded as indicated at GND in FIG. 7. Then, the transistor Tr2 is turned off to keep the gate electrode 22-1 at a high impedance as indicated at Z in FIG. 7.

In this instance, the gate electrode is grounded once during a period of time (one-frame period) before it is selected again and kept at the high impedance Z during the remaining period of time, so that a current path is formed during only the period R for which the resent pulse is applied, to thereby reduce a reactive current. However, this, as shown in (c) of FIG. 7, causes an off-state voltage ($\Delta V$) of the gate electrode to be gradually increased due to leakage of a voltage from the cathode electrode during the high impedance period. An increase in off-state voltage above the threshold voltage $V_{TH}$ causes luminescent spots to occur on an image plane, to thereby deteriorate quality of display of the image display device.

Further, the conventional image display device is constructed so as not to apply the bias voltage $V_S$ to each of the gate drivers, to thereby provide a margin for the leakage voltage. Unfortunately, this causes the gate voltage to be equal to the swing voltage, to thereby cause the swing voltage to be increased by about 20 to 30 volts as compared with application of bias voltage $V_S$, leading to an increase in power consumption.

SUMMARY OF THE INVENTION

The present invention has been made in view of the foregoing disadvantage of the prior art.

Accordingly, it is an object of the present invention to provide a method for driving an image display device which is capable of accomplishing driving of the image display device while effectively preventing occurrence of luminescent spots on an image plane for display.

It is another object of the present invention to provide a method for driving an image display device which is capable of substantially reducing power consumption.

It is a further object of the present invention to provide a unit for driving an image display device which is capable of accomplishing driving of the image display device while effectively preventing occurrence of luminescent spots on an image plane for display.

It is still another object of the present invention to provide a unit for driving an image display device which is capable of substantially reducing power consumption.

In accordance with one aspect of the present invention, a method for driving an image display device which includes a plurality of gate electrodes and a plurality of cathode electrodes which are arranged so as to define a matrix by cooperation with each other is provided. The method comprises the steps of acting one of the gate electrodes and cathode electrodes as scan electrodes and applying image data to the other of the gate electrodes and cathode electrodes, and applying at least two reset pulses to the scan electrodes during a period of time for which the scan electrodes are kept nonselected to keep the scan electrodes at a reference potential and keeping the scan electrodes at a high impedance during a period of time for which the reset pulses are kept from being applied to the scan electrodes.

In a preferred embodiment of the present invention, the gate electrodes act as the scan electrodes.

In accordance with another aspect of the present invention, a unit for driving an image display device is provided. The drive unit includes a plurality of stripe-like gates and a plurality of stripe-like cathodes which are arranged so as to define a matrix by cooperation with each other, emitters arranged on portions of the cathodes defined on intersections of the matrix to field-emit electrons due to application of a voltage of a predetermined level between the gates and the cathodes, an anode arranged above the gates in a manner to be spaced therefrom for capturing electrons emitted from the emitters, phosphors arranged on the anode, a gate drive means for driving the gates depending on gate data, and a cathode drive means for driving the cathodes depending on cathode data. The gate drive means is applied thereto at least two reset pulses during a non-selection period to keep the gates at a reference voltage and permits the gates to be kept at a high impedance during a period of time for which the reset pulses are kept from being applied to the gate drive means.

In the present invention constructed as described above, at least two reset pulses are fed to the drive means during a period of time for which the scan electrodes are kept nonselected, resulting in the scan electrodes being discharged. Also, the scan electrodes are kept at a high impedance during a period of time for which the rest pulses are kept from being applied to the drive means. Thus, the present invention effectively prevents leakage luminescence due to a leakage voltage. Also, a high impedance of the scan electrodes permits a decrease in power consumption of the device.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, the present invention will be described hereinafter with reference the accompanying drawings.

Figure 1:
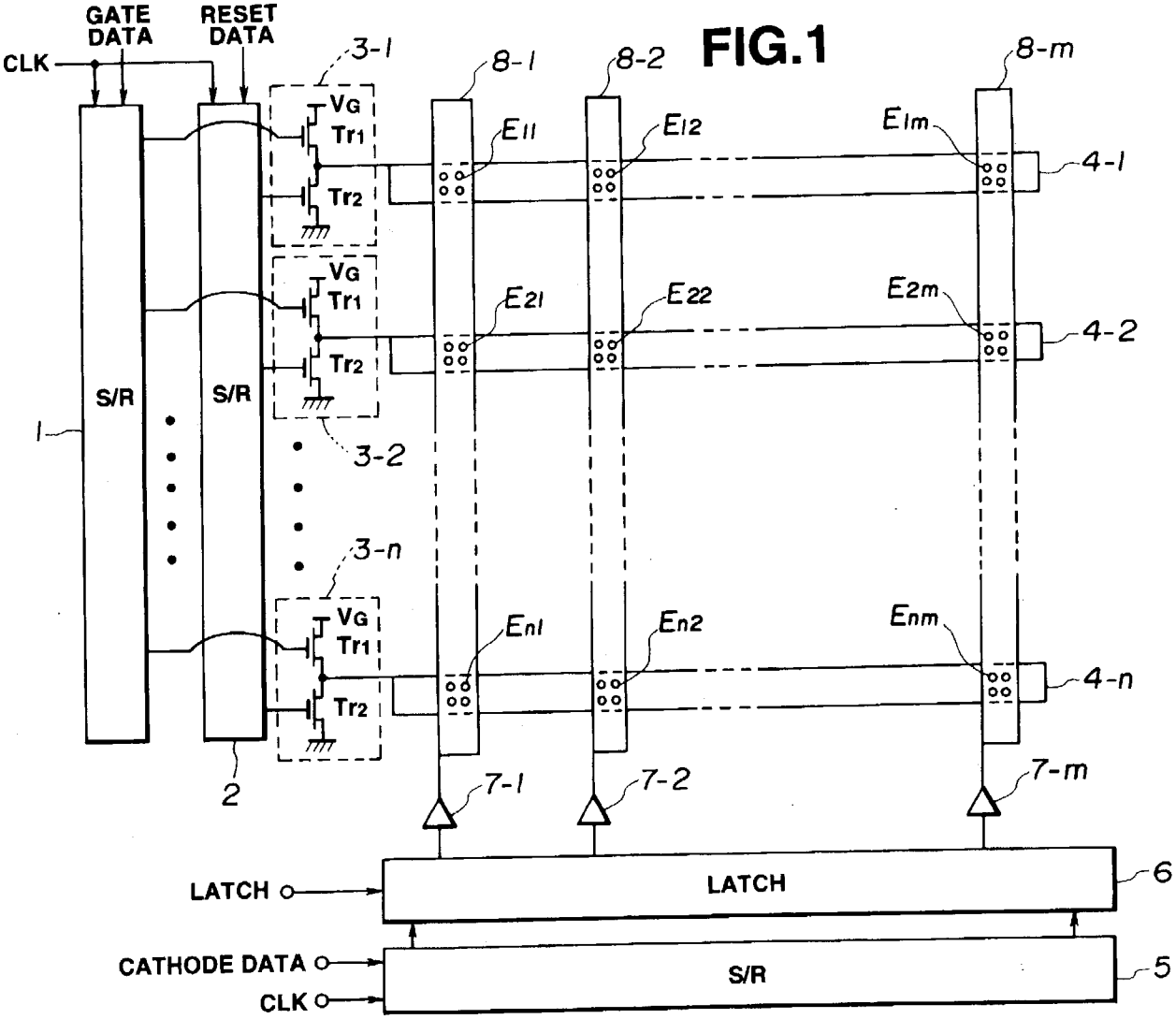
FIG. 1 is a block diagram showing an embodiment of a unit for driving an image display device according to the present invention.
Figure 2:
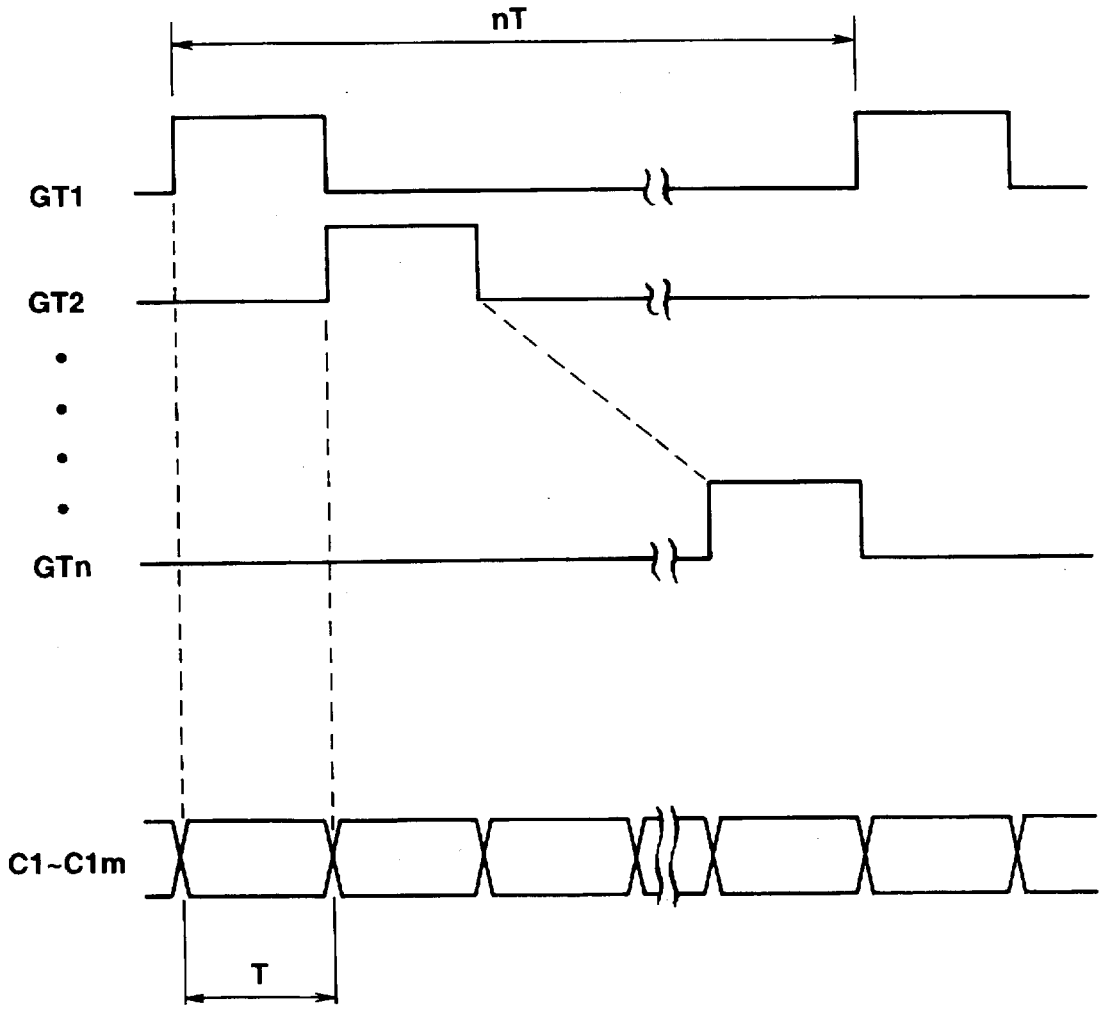
FIG. 2 is a group of waveform diagrams showing operation waveforms of a gate data and cathode data.

Referring first to FIG. 1, an embodiment of a unit for driving an image display device according to the present invention is illustrated. In FIG. 1, reference numeral 1 designates a shift register to which gate data and clocks CLK for shift are inputted. The shift register 1 feeds the gate data to terminals of gates of transistors Tr1 of gate drivers 3-1 to 3-n in order. The gate data applied to the gate drivers 3-1 to 3-n each are in the form of a sequence pulse as indicated at each of GT1 to GTn in FIG. 2, which is generated at a generation cycle nT wherein T is a pulse width of the sequence pulse.

Reference numeral 2 likewise designates a shift register, to which reset data and clocks CLK for shift are input. The shift register 2 feeds the reset data to terminals of gates of transistors Tr2 of the gate drivers 3-1 to 3-n in order.

The gate drivers 3-1 to 3-n each may be constructed of a driver IC or the like and have the transistors Tr1 and Tr2 connected thereto to constitute a push-pull circuit, to thereby permit each of gate electrodes 4-1 to 4-n to be driven at an increased speed.

The transistors Tr1 and Tr2 are driven independently from each other. The transistor Tr1 of each of the gate drivers is connected at a terminal of a source thereof to a drive power supply $V_G$ and the transistor Tr2 is grounded at a terminal of a source thereof.

The gate electrodes 4-1 to 4-n each are formed into a stripe-like shape and the gate drivers 3-1 to 3-n are adapted to drive the gate electrodes 4-1 to 4-n in turn, respectively.

Reference numeral 5 designates a shift register to which serial cathode data are inputted. The shift register 5 functions to convert the serial cathode data into parallel cathode data, which are then latched by a latch circuit 6. For this purpose, the shift register 5 has clocks CLK for shift inputted thereto.

The parallel cathode data latched by the latch circuit 6 are fed to cathode drivers 7-1 to 7-m, respectively. The data thus fed to the cathode drivers function as image data of a cycle T as indicated at C1 to Cm in FIG. 2.

The drive unit of the illustrated embodiment further includes cathode electrodes 8-1 to 8-m each formed into a stripe-like shape. The cathode electrodes 8-1 to 8-m are driven by the cathode drivers 7-1 to 7-m in turn, respectively. The gate electrodes 4-1 to 4-n and cathode electrodes 8-1 to 8-m are arranged so as to define a matrix by cooperation with each other. The cathode electrodes 8-1 to 8-m are provided on portions thereof positionally corresponding to intersections between the gate electrodes 4-1 to 4-n and the cathode electrodes 8-1 to 8-m with emitter arrays $E_{11}, E_{12}, ---, E_{21}, E_{22}, ---, E_{nm}$, which constitute picture cells for the image display device.

Figure 3:
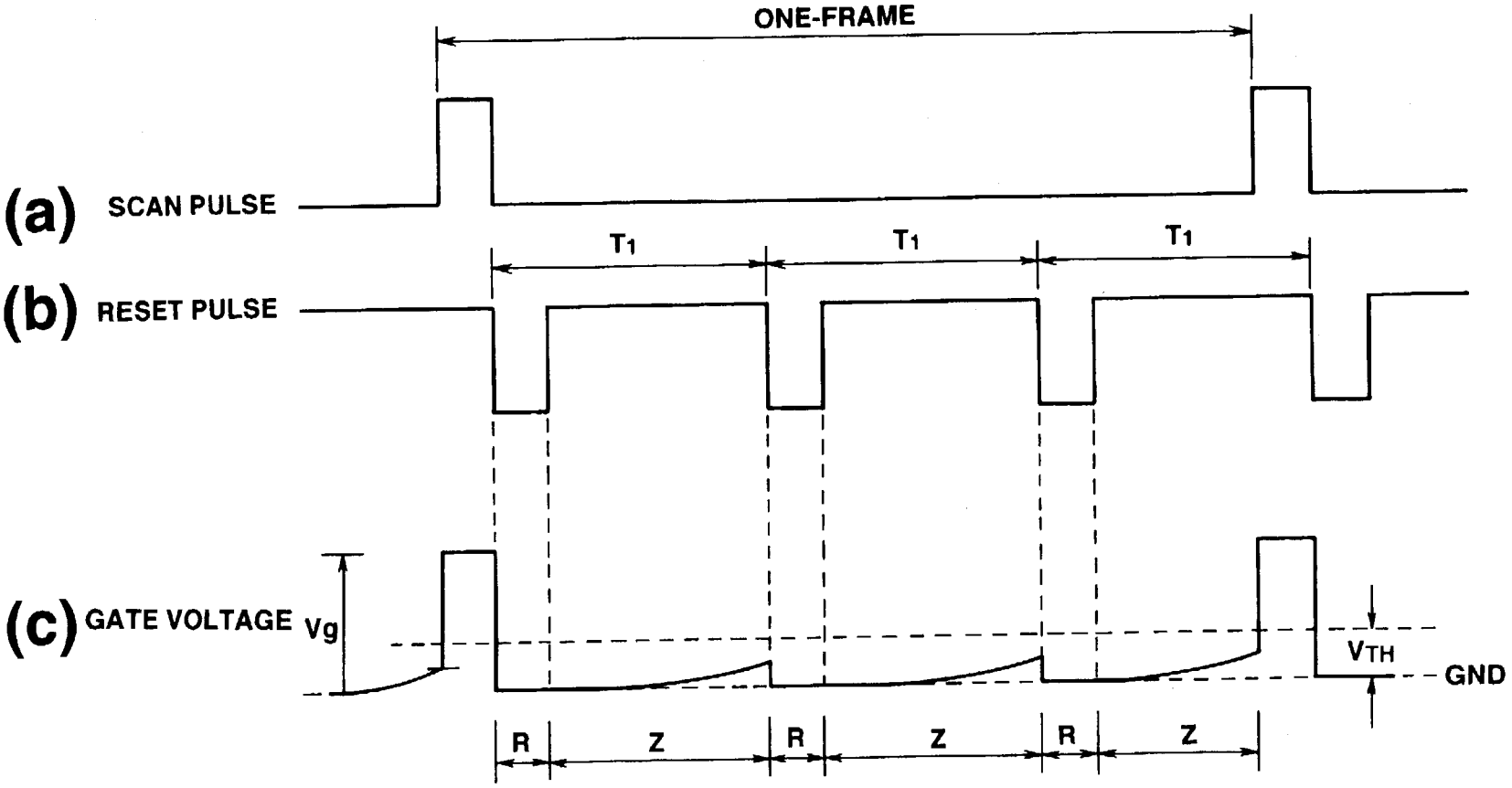
FIG. 3 is a group of waveform diagrams showing operation waveforms of any selected gate driver and gate electrode.
Figure 4:
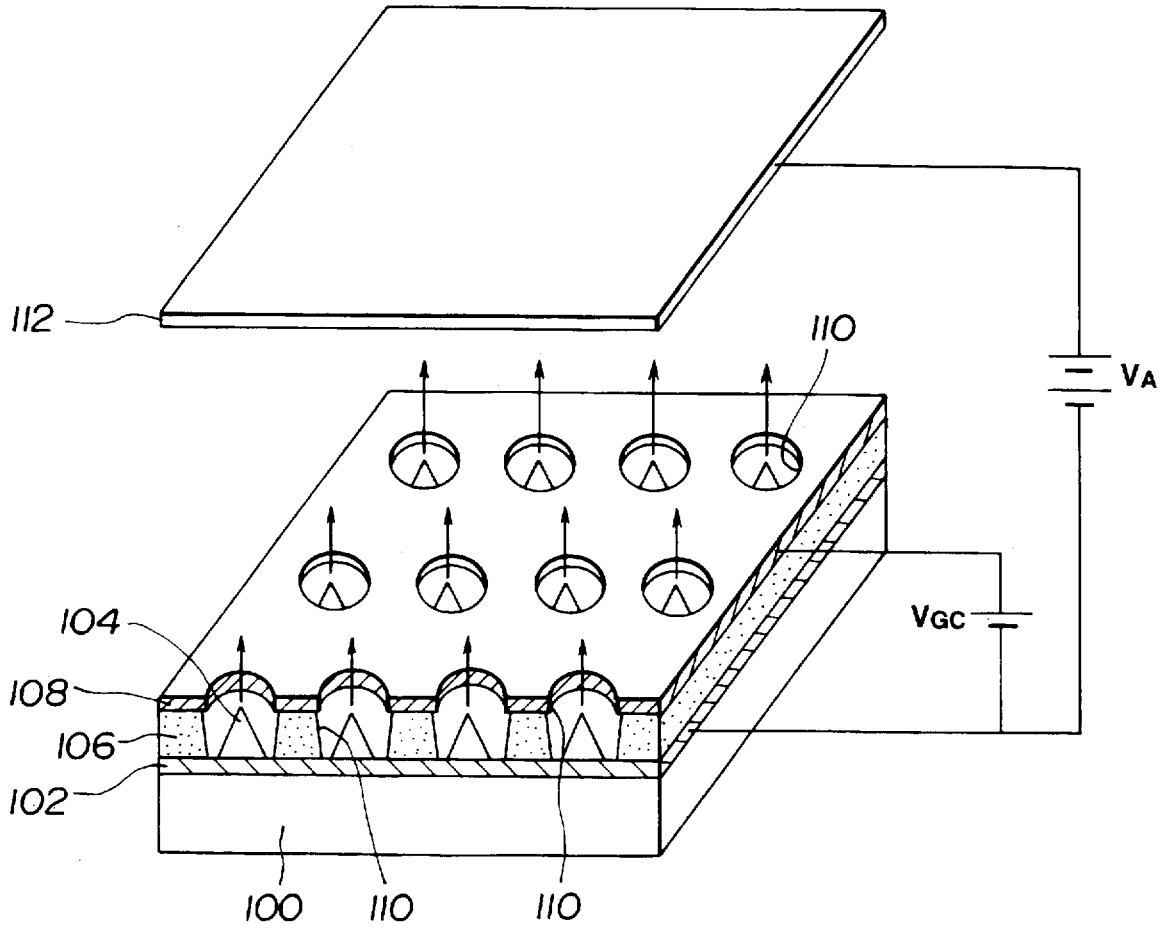
FIG. 4 is an exploded perspective view showing a field emission cathode of the Spindt type.
Figure 5:
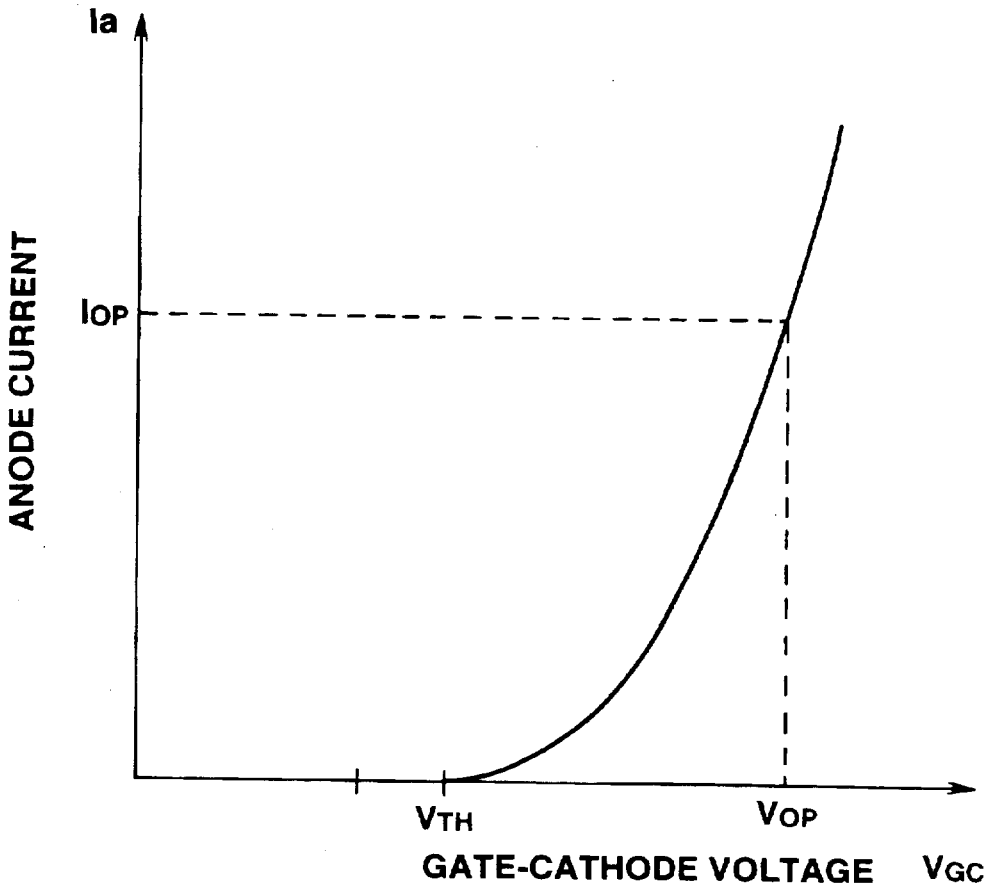
FIG. 5 is a graphical representation showing characteristics between an anode current and a gate-cathode voltage in a field emission cathode.
Figure 6:
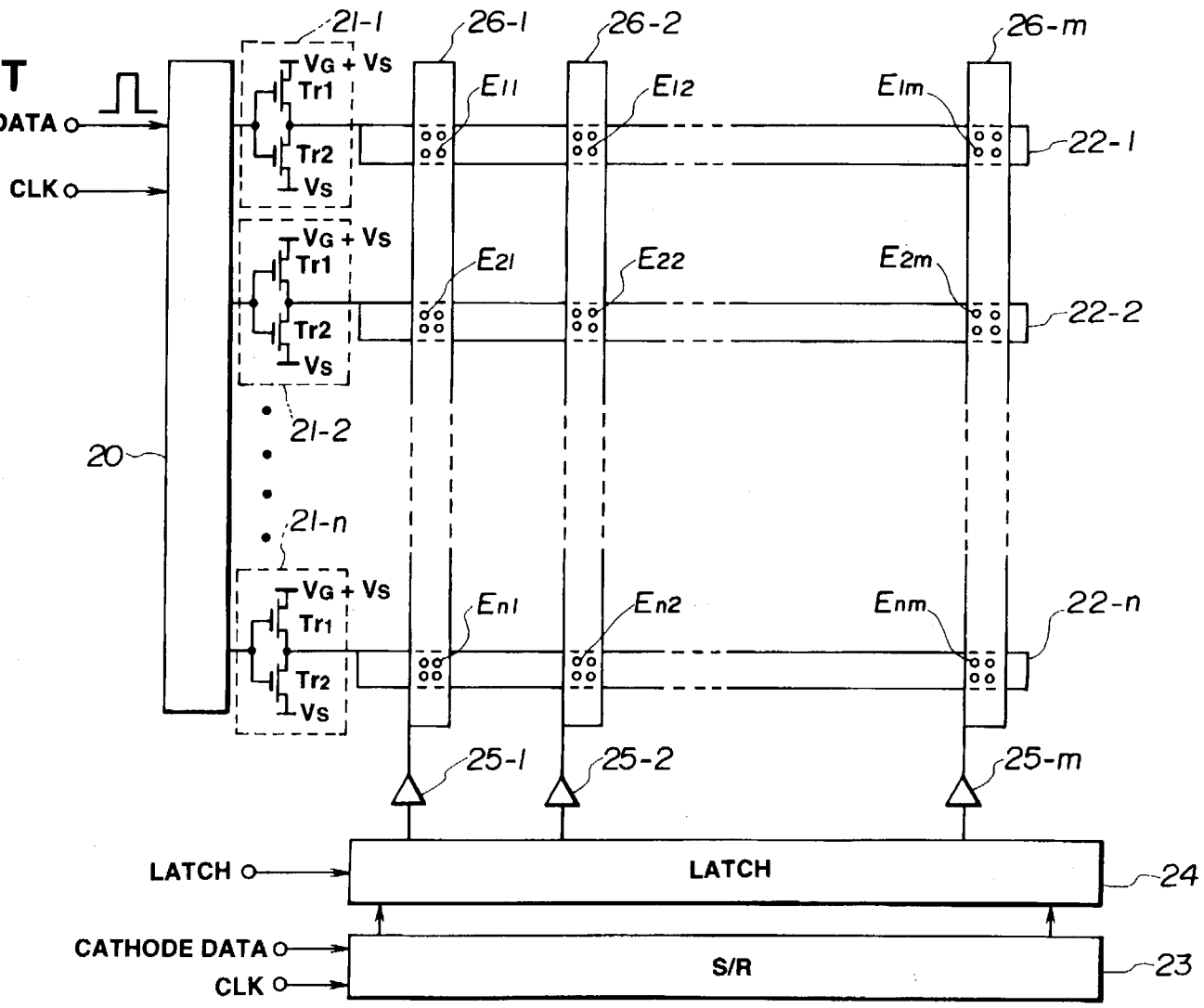
FIG.6 PRIOR ART
FIG. 6 is a block diagram showing a conventional unit for driving an image display device.
Figure 7:
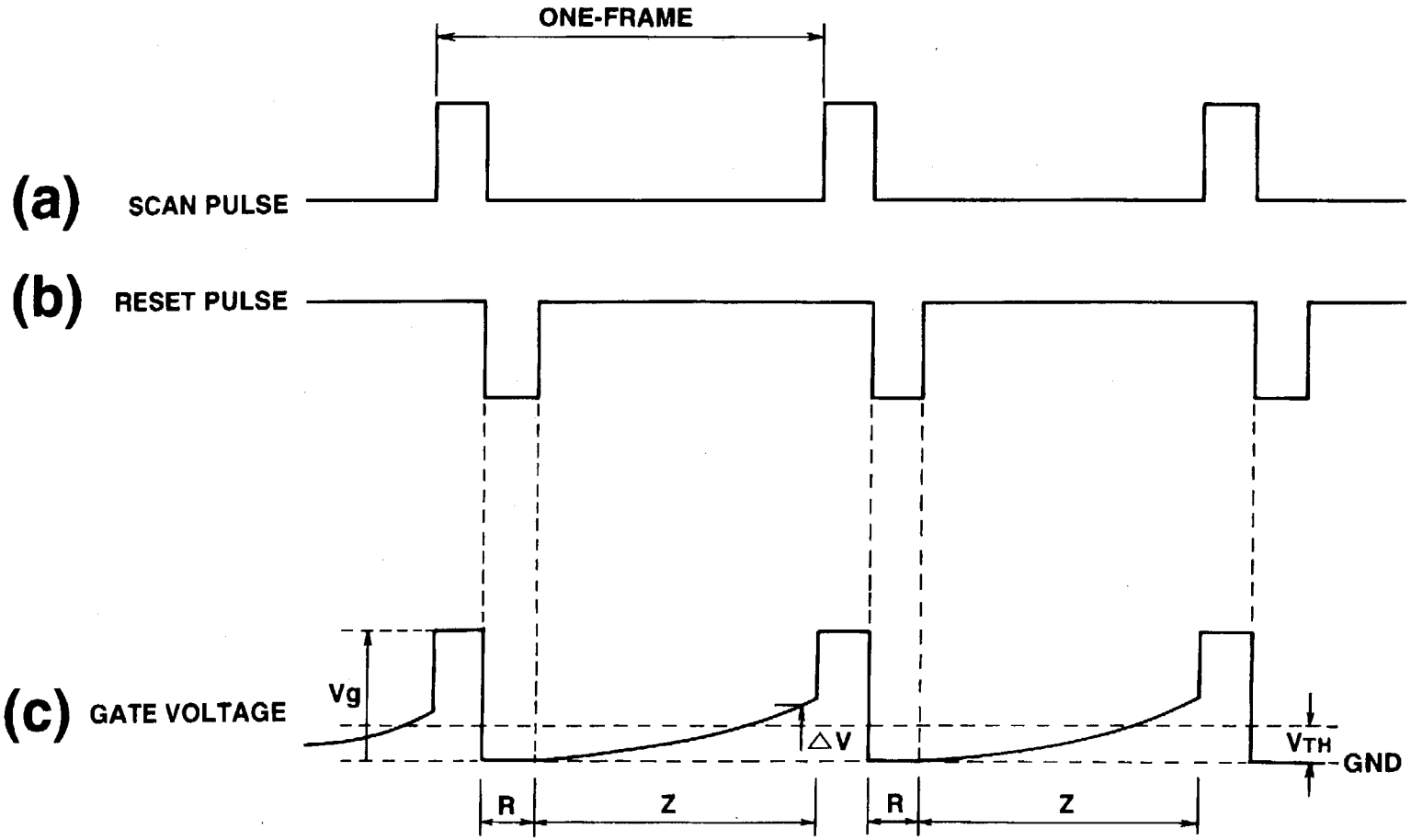
FIG.7 PRIOR ART
FIG. 7 is a group of waveform diagrams showing operation waveforms of a gate driver and a gate electrode conventionally used.

Thus, supposing that such a scan pulse as shown in (a) of FIG. 3 is applied to the transistor Tr1 of the gate driver 3-1, the transistor Tr1 of the gate driver 3-1 is turned on to cause a voltage Vg to be applied to the gate electrode 4-1, resulting in a voltage of a predetermined level being applied between the gate electrode and the cathode electrodes 8-1 to 8-m, so that electrons may be emitted from the emitter arrays. The electrons thus emitted are captured by an anode (not shown) arranged above the gate electrodes 4-1 to 4-n in a manner to be spaced therefrom.

The anode has phosphors deposited thereon, on which electrons emitted from each of the emitter arrays are impinged to excite them, leading to luminescence of the phosphors. In this instance, the image data are kept applied to the cathode electrodes 8-1 to 8-m as described above, so that luminescence of the phosphors is carried out depending on the image data, resulting in displaying an image desired.

In the drive unit of the illustrated embodiment, for example, when a scan pulse applied to the gate driver 3-1 is transferred therefrom to the next gate driver 3-2 to render the gate driver 3-1 nonselected, the transistor Tr1 of the gate driver 3-1 is turned off and the transistor Tr2 thereof has such reset pulses as shown in (b) of FIG. 3 applied thereto for a predetermined period of time R. This causes a gate voltage applied to the gate electrode 4-1 to be at a low level, followed by turning-off of the transistor Tr2, so that the gate electrode 4-1 may be kept at a high impedance Z.

Then, when a predetermined period of time $T_1$ elapses the reset pluses are applied to the transistor Tr2 of the gate driver again, so that the reset pulse may be applied thereto, for example, three times during a period of time before the gate electrode is selected again.

Thus, even when an off-state potential of each of the gate electrodes is gradually increased as shown in (c) of FIG. 3 due to a leakage voltage from the cathode electrode when the gate electrode is kept at a high potential, application of the reset pulses is carried out again before the off-state voltage is increased to a level above a threshold voltage $V_{TH}$, so that the off-state potential of the gate electrode is returned to a low level. This prevents the off-state potential of the gate electrode from being increased above the threshold voltage $V_{TH}$ even when the gate electrode is connected to a bias power supply $V_S$, resulting in preventing luminescent spots from occurring on a display plane.

Even when the transistor Tr2 of each of the gate drivers 3-1 to 3-n is connected to the bias power supply $V_S$, an increase in off-state potential of the gate electrode above the threshold voltage $V_{TH}$ is effectively prevented by carrying out application of the reset pulse, for example, three times. This permits each of the gate electrodes 4-1 to 4-n to be driven at a reduced swing voltage, so that an image may be displayed while minimizing power consumption.

Although the illustrated embodiment is so constructed that the reset pulse is applied to the transistor three times at a cycle $T_1$ during a one-frame period, it is not limited to such construction. In the illustrated embodiment, it is merely required that the number of times of application of the reset pulse during a one-frame period is set so as to prevent the off-state potential of each of the gate electrodes from being increased above the threshold voltage.

Also, a pulse width of the reset pulse may be set as desired so long as it permits the off-state potential of the gate electrode to be at a low level.

As can be seen from the foregoing, the present invention is so constructed that at least two reset pulses are applied to the gate drive means during a period of time for which the gate drive means is kept nonselected. Such construction effectively prevents an off-state potential of each of the gate electrodes from being increased above the threshold voltage even when it is increased due to a leakage voltage from the gate electrode, resulting in luminescent spots from occurring on a display plane.

Also, the present invention may be so constructed that the gate drive means is connected to the bias power supply, to thereby be driven at a low swing voltage. Such construction substantially reduces power consumption as compared with the prior art.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A unit for driving an image display device, comprising:

a plurality of gates and a plurality of cathodes which are arranged so as to define a matrix by cooperation with each other;

emitters arranged on portions of said cathodes defined on intersections of said matrix to field-emit electrons due to application of a voltage of a predetermined level between said gates and said cathodes;

an anode arranged above said gates in a manner to be spaced therefrom for capturing electrons emitted from said emitters;

phosphors arranged on said anode;

a gate drive means for driving said gates depending on gate data; and a cathode drive means for driving said cathodes depending on cathode data;

said gate drive means being applied thereto at least two reset pulses during a non-selection period to keep said gates at a reference voltage and permitting said gates to be kept at a high impedance during a period of time for which said reset pulses are kept from being applied to said gate drive means.

2. A unit for driving an image display device according to claim 1, wherein said plurality of gates are stripe-like and wherein said plurality of cathodes are stripe-like.

* * * * *

UNITED STATES PATENT AND TRADEMARK OFFICE

CERTIFICATE OF CORRECTION

PATENT NO. : 5,896,115

DATED : April 20, 1999

INVENTOR(S) : Kazuyuki YANO, et al.

It is certified that error appears in the above-identified patent and that said Letters Patent is hereby corrected as shown below:

On the title page, item [73], the assignee's name should be:

--Futaba Denshi Kogyo, K.K.--

Signed and Sealed this

Twenty-eighth Day of March, 2000

*Attest:*

Q. TODD DICKINSON

*Attesting Officer*

*Commissioner of Patents and Trademarks*